US006599096B1

(12) United States Patent
Totten et al.

(10) Patent No.: US 6,599,096 B1
(45) Date of Patent: Jul. 29, 2003

(54) STEAM DRIVEN PUMP

(75) Inventors: Timothy K. Totten, Marcellus, MI (US); Matthew R. McNamara, Centreville, MI (US)

(73) Assignee: Armstrong International, Inc., Three Rivers, MI (US)

( * ) Notice: Subject to any disclaimer, the term of this patent is extended or adjusted under 35 U.S.C. 154(b) by 0 days.

(21) Appl. No.: 09/907,409

(22) Filed: Jul. 17, 2001

(51) Int. Cl.[7] ..... F04F 1/00

(52) U.S. Cl. ..... 417/133; 417/130; 417/131; 417/134

(58) Field of Search ..... 417/130, 131, 417/133, 134

(56) References Cited

U.S. PATENT DOCUMENTS

| | | | | | |
|---|---|---|---|---|---|
| 5,141,405 | A | * | 8/1992 | Francart, Jr. | 417/133 |
| 5,426,990 | A | | 6/1995 | Francart, Jr. | |
| 5,445,501 | A | | 8/1995 | Yumoto | |
| 5,517,008 | A | | 5/1996 | Francart, Jr. | |
| 5,655,888 | A | | 8/1997 | Yumoto | |
| 5,865,603 | A | | 2/1999 | Francart, Jr. | |
| 6,099,260 | A | * | 8/2000 | Reynolds | 417/126 |
| 6,158,664 | A | | 12/2000 | Klann | |
| 6,244,829 | B1 | * | 6/2001 | Yumoto | 137/165 |

OTHER PUBLICATIONS

Armstrong, The Armstrong Pumping Trap, Nov. 1997, Armstrong Fluid Handling Inc., Bulletin No. 230–C 15M, pp. 3 and 5.*

Bulletin No. 230–C, The Armstrong Pumping Trap brochure, Nov. 1997.

* cited by examiner

*Primary Examiner*—Charles G. Freay
*Assistant Examiner*—Emmanuel Sayoc
(74) *Attorney, Agent, or Firm*—MacMillan, Sobanski & Todd, LLC

(57) ABSTRACT

A pump includes a valve mechanism having an opened position and a closed position. The pump further includes a spring assisted mechanism for selectively moving the valve mechanism between the opened position and the closed position, and a fluid detector for detecting the level of a pumping fluid. The fluid detector is pivotally connected to the spring assisted mechanism and has a first range of pivotal travel and a second range of pivotal travel. The fluid detector further engages a spring of the spring assisted mechanism only at one portion of the first range of pivotal travel, and engages the spring of said spring assisted mechanism only at one portion of the second range of pivotal travel. The fluid detector is disengaged from the spring of the spring assisted mechanism at all other portions of the first range of pivotal travel and of the second range of pivotal travel.

13 Claims, 6 Drawing Sheets

STEAM DRIVEN PUMP

BACKGROUND OF INVENTION

This invention relates in general to a pump, and more particularly to a steam driven pump for draining fluid from a container.

Pump assemblies with over-center snap-action mechanisms are useful in controlling the filling of a closed or sealed pressure vessel. For example, U.S. Pat. No. 6,099,260 to Francart, Jr. discloses a pressure vessel having a poppet type vent valve for venting the interior of the vessel to the surrounding atmosphere, a plurality of gas inlet valves subjected to high pressure inlet fluid, and a plurality of compression springs. During filling of the pressure vessel, the vent valve is in the open position and the pressure valves are closed by a float operated over-center snap-action valve actuating mechanism. As the vessel fills with fluid, the float rises and a rotatable float arm, forming part of the valve actuating mechanism, is rotated about a pivot point at one end, causing an over-center toggle linkage mechanism to move toward the center position against a spring bias. Such a mechanism has toggle linkage elements which snap quickly through the center position, closing the vent valve while simultaneously snap opening the plurality of high pressure inlet valves to pump the accumulated liquid from the vessel. Typically a compression coil spring provides such a biasing force with one end of the coil spring coupled to a fixed or stationary member of the valve mechanism or vessel.

While such over-center snap-action valve mechanisms operate satisfactorily to automatically control the liquid inflow and outflow from the pressure vessel, such known mechanisms are complex, difficult to maintain, and expensive. Further, the biasing force is always present as the float rises and lowers within the vessel, and the float must be sufficiently buoyant to overcome the large spring force or spring rate of the plurality of compression springs.

It would therefore be advantageous to provide a pump that is reliable, has a simple design, and easy to maintain and repair. It would further be advantageous to provide a pump in which the float is connected to the valve actuating mechanism and is not biased by a spring during its entire range of pivotal travel.

SUMMARY OF THE INVENTION

The above objects as well as other objects not specifically enumerated are achieved by a pump including a valve mechanism having an opened position and a closed position. The pump further includes a spring assisted mechanism for selectively moving the valve mechanism between the opened position and the closed position, and a fluid detector for detecting the level of a pumping fluid. The fluid detector is pivotally connected to the spring assisted mechanism and has a first range of pivotal travel and a second range of pivotal travel. The fluid detector further engages a spring of the spring assisted mechanism only at one portion of the first range of pivotal travel, and engages the spring of the spring assisted mechanism only at one portion of the second range of pivotal travel. The fluid detector is disengaged from the spring of the spring assisted mechanism at all other portions of the first range of pivotal travel and of the second range of pivotal travel.

In another embodiment of the invention, the pump includes a container and a valve block mounted to the container. The valve block has a body, a pressurized fluid inlet valve, and a pressure release valve. The valve block is further readily removable from the container.

In an additional embodiment of the invention, the pump includes a container and a valve block which has a valve mechanism. An actuator is connected to the valve block and mounted to travel with respect to the valve block. The actuator further selectively actuates the valve mechanism between opened and closed positions. A fluid detector for detecting the level of a pumping fluid is mechanically linked to the actuator. The actuator is arranged to travel a predetermined distance relative to the valve block before the actuator actuates the valve mechanism between the opened and the closed positions.

Various objects and advantages of this invention will become apparent to those skilled in the art from the following detailed description of the preferred embodiment, when read in light of the accompanying drawings.

DETAILED DESCRIPTION OF THE INVENTION

Figure 1:
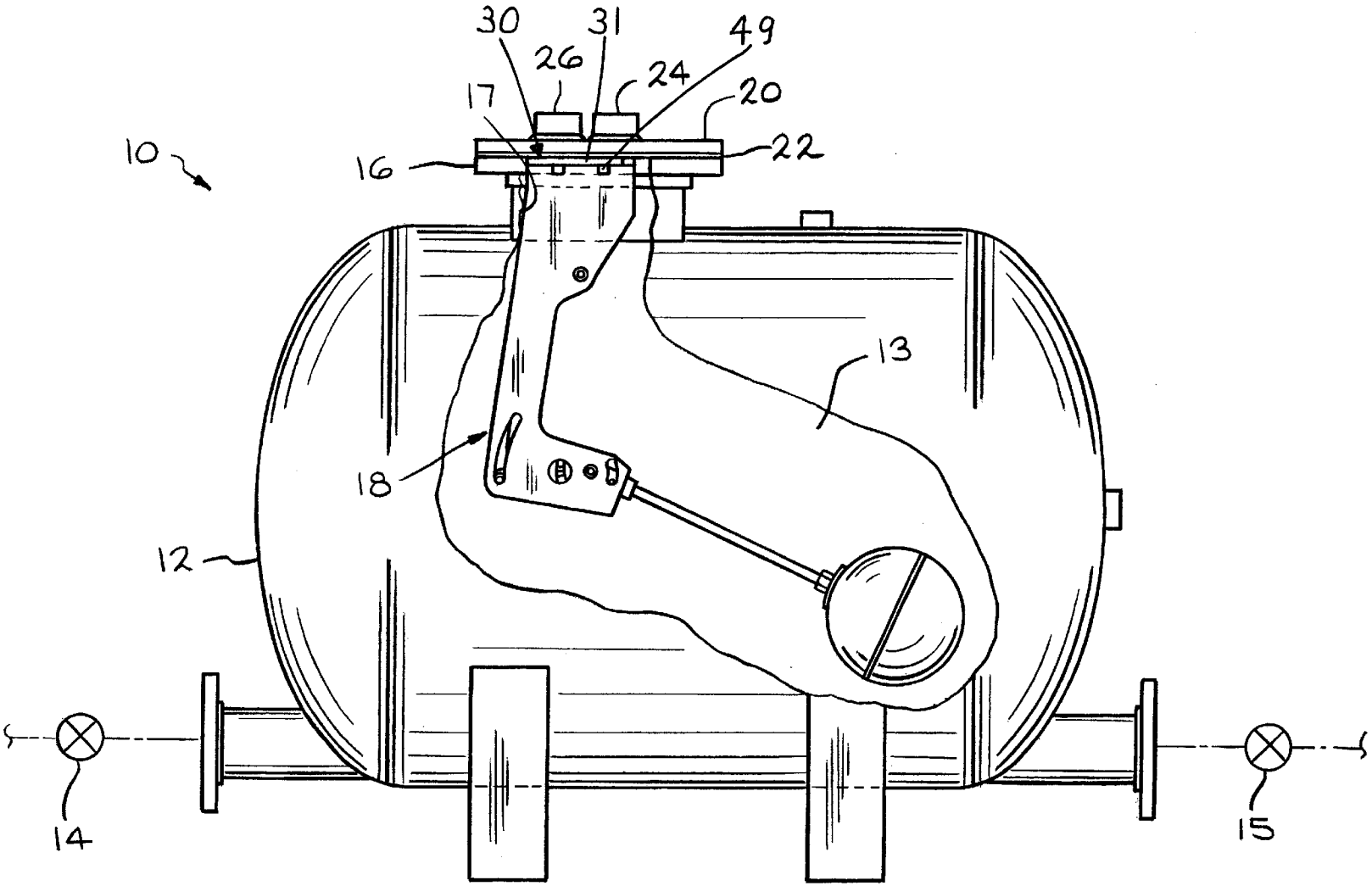
FIG. 1 is a side elevational view, partially in cross-section, of the steam driven pump of the invention.

Referring now to the drawings there is illustrated in FIG. 1 a steam driven pump shown generally at 10. Typically, the steam driven pump includes a container or tank 12. The tank 12 has a generally hollow interior 13 and includes a fluid inlet valve 14 and a fluid outlet valve 15. The fluid inlet valve 14 and fluid outlet valve 15 may be any suitable type of fluid valve, such as, for example, a swing check valve or a piston check valve. The tank 12 further includes a mounting flange 16 disposed about a generally cylindrical opening 17.

The steam driven pump 10 also typically includes a pump assembly shown generally at 18. The pump assembly 18 is typically transversely mounted to a generally annular cap flange 20, and extends through the opening 17 in the tank 12. The cap flange 20 typically includes a steam inlet port 24 connected to a source of steam (not shown) and a pressurized-fluid outlet port 26 for venting the interior 13 of the tank 12 formed therein. Typically the interior 13 of the tank 12 is vented into the atmosphere. The cap flange 20 is sealingly mounted to the mounting flange 16 by any suitable means, such as, for example, threaded fasteners (not shown). Typically, an annular seal 22 is disposed between the cap flange 20 and the mounting flange 16 and provides a seal therebetween.

Figure 2:
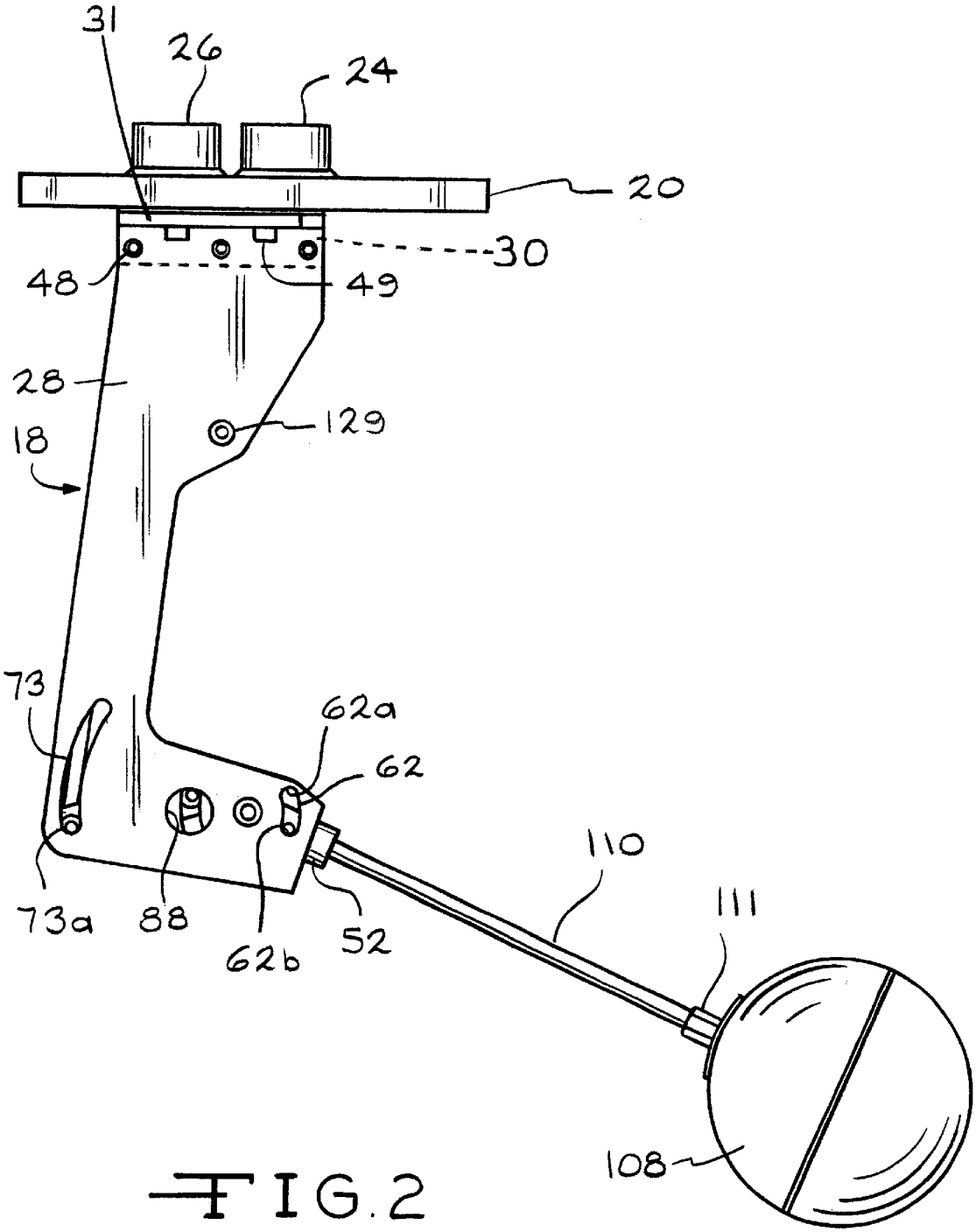
FIG. 2 is a side elevational view of the pump assembly illustrated in FIG. 1.
Figure 3:
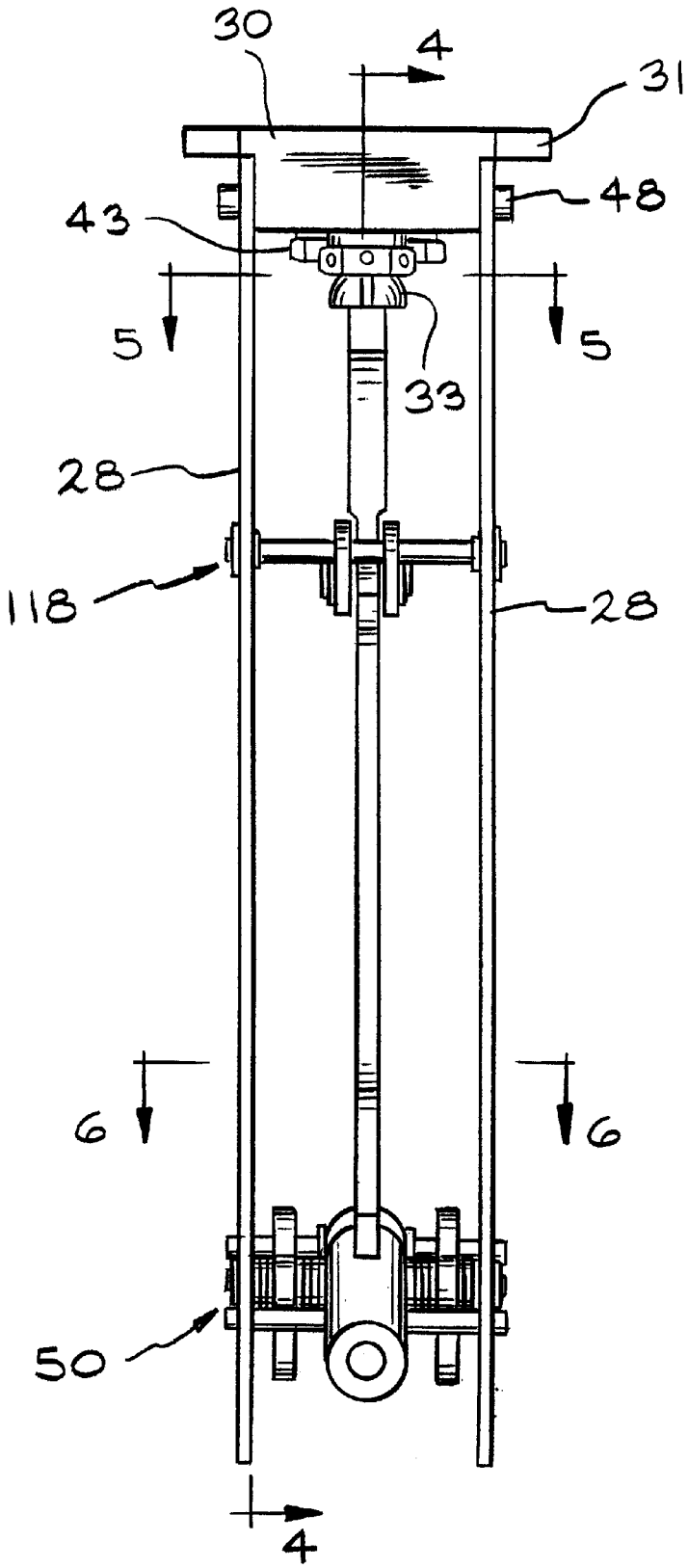
FIG. 3 is a front elevational view of the pump assembly illustrated in FIG. 2.
Figure 4:
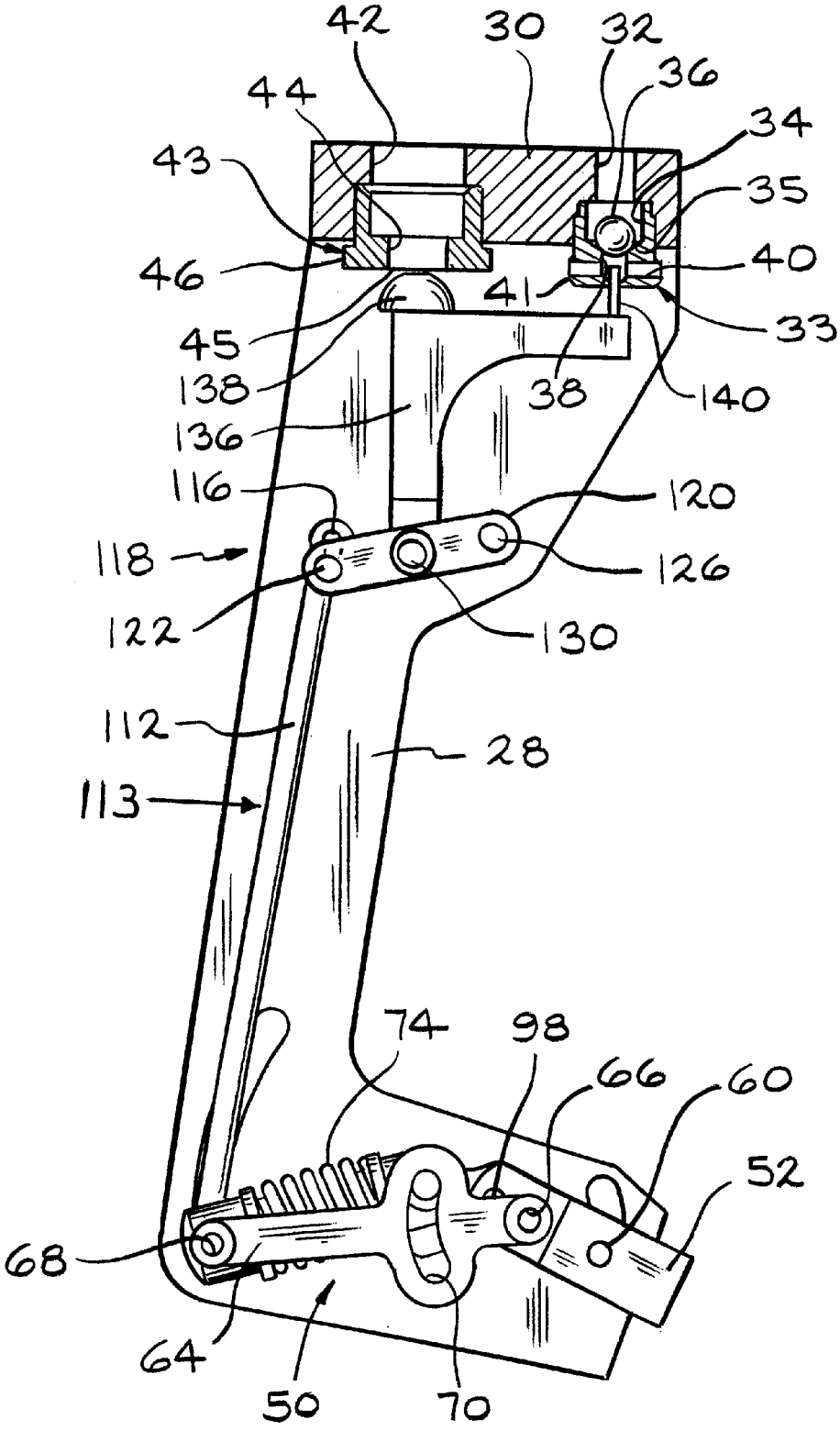
FIG. 4 is a cross-sectional view of the pump assembly taken along line 4—4 of FIG. 3.

Referring now to FIGS. 2 through 4, the pump assembly 18 includes generally C-shaped frame plates 28 and a valve block 30. The valve block 30 is generally rectangular and includes flange portions 31 extending outwardly from two opposing sides thereof. An inlet conduit 32 is formed through the valve block 30. A portion of the inlet conduit 32 is typically threaded for receiving an externally threaded steam inlet valve assembly 33. The steam inlet valve assembly 33 is generally cylindrical and includes a first axial passage 34, a generally annular valve seat 35 for supporting a generally spherical valve 36, and a flange portion 41. The valve 36 cooperates with the valve seat 35 to close and open the steam inlet valve assembly 33. The valve assembly 33 is commonly known as a ball check valve. The flange portion 41 is preferably hexagonally shaped for receiving a tool (not shown) for installing the valve assembly 33. A second axial passage 38 extends through the valve assembly 33 opposite the valve seat 35. A plurality of radially extending passages 40 are formed in the flange portion 41 of the valve assembly 33 and provide fluid communication between the axial passage 38 and the interior 13 of the tank 12.

An outlet conduit 42 is formed through the valve block 30 adjacent the inlet conduit 32. A portion of the outlet conduit 42 is typically threaded for receiving an externally threaded vent valve assembly 43. The vent valve assembly 43 is generally cylindrical and includes an axial passage 44, a generally annular valve seat 45, and a flange portion 46. The flange portion 46 is preferably hexagonally shaped for receiving a tool (not shown) for installing the valve assembly 43. Each frame plate 28 is typically attached to opposing sides of the valve block 30, adjacent the flanges 31, by a plurality of suitable fasteners 48, such as, for example, threaded fasteners. The pump assembly 18 is mounted to the cap flange 20 by any suitable means, such as, for example, threaded fasteners 49 extending through apertures (not shown) in the flange portions 31 of the valve block 30.

An important aspect of the invention is that the valve block 30 is readily removable from the pump assembly 18, and readily removable from the cap flange 20. Readily removable is defined as the valve block 30 being capable of being disconnected from each of the frame plates 28 of the pump assembly 18 by removal of all of the plurality of fasteners 48, and being capable of being disconnected from the cap flange 20 by removal of all of the plurality of fasteners 49. The valve block 30 can therefore be disconnected and removed from the pump assembly 18 without the disassembly of the fame plates 28, mechanism 50, and linkage 118. The readily removable feature of the valve block 30 further allows easy access the maintenance, repair, and replacement of the inlet valve assembly 33 and the vent valve assembly 43.

Figure 6:
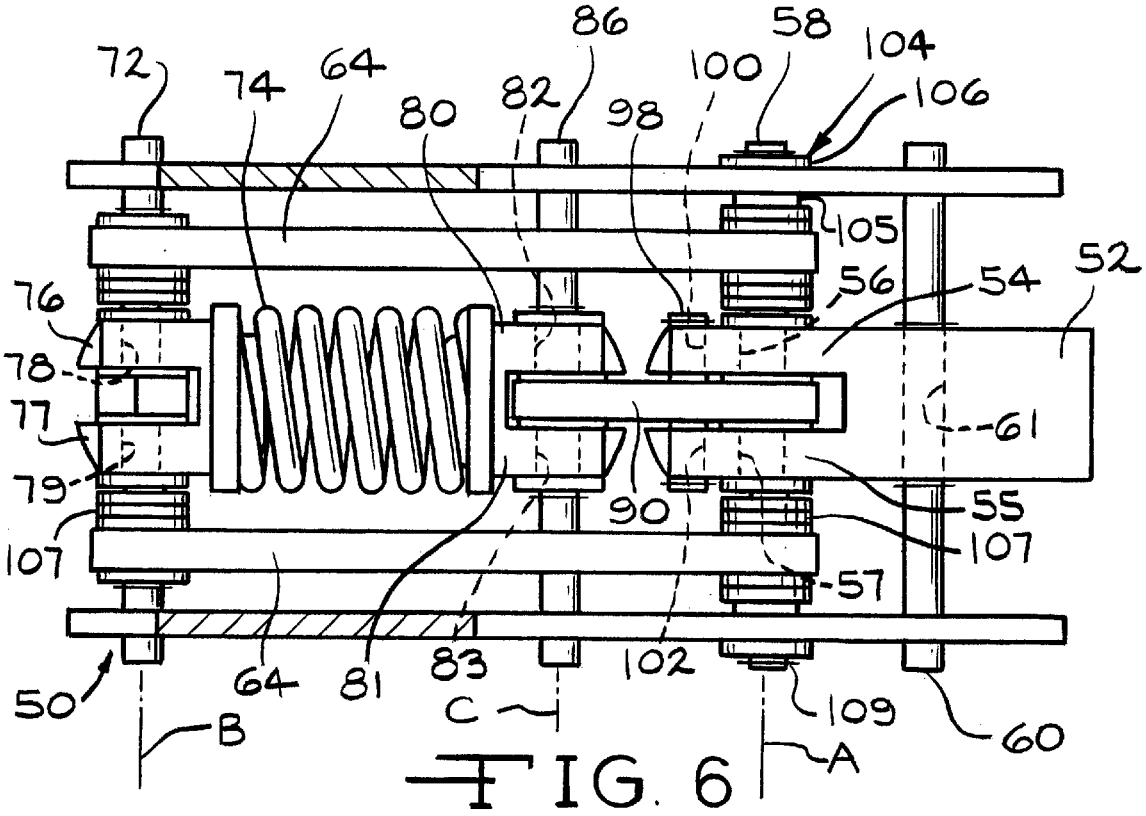
FIG. 6 is a cross-sectional view of the pump assembly taken along line 6—6 of FIG. 3.

Referring now to FIGS. 4 and 6, the pump assembly 18 further typically includes an over-center snap-action mechanism, shown generally at 50. The mechanism 50 includes a float arm 52 having a pair of outwardly extending fingers 54 and 55. The fingers 54 and 55 are substantially parallel and spaced apart from each other. A first pivot pin 58 passes through a first aperture 56 in the finger 54 and passes through a first aperture 57 in the finger 55 to pivotally mount the float arm 52 to the frame plates 28 about a pivot axis A. A second pin 60 passes through an aperture 61 in the float arm 52 and further extends through a first arcuate slot 62 of each frame plate 28.

A pair of elongate spring arms 64 are pivotally mounted to the first pivot pin 58 about the pivot axis A. The spring arms 64 include a first aperture 66 for pivotal engagement with first pivot pin 58, a second aperture 68, and an arcuate slot 70. A third pivot pin 72 passes through the second aperture 68 in each spring arm 64 to pivotally mount the spring arms 64 about a second pivot axis B. The third pivot pin 72 slidingly mounts each spring arm 64 to each frame plate 28 at a second arcuate slot 73.

A helical spring 74 includes a first end having a pair of outwardly extending fingers 76 and 77. The fingers 76 and 77 are substantially parallel and spaced apart from each other. The third pivot pin 72 passes through an aperture 78 in the finger 76 and passes through an aperture 79 in the finger 77 to pivotally mount the first end of the spring 74 to each frame plate 28 about the pivot axis B intermediate the pair of spring arms 64. A second end of the spring 74 includes a pair of outwardly extending fingers 80 and 81. The fingers 80 and 81 are substantially parallel and spaced apart from each other. A fourth pivot pin 86 passes through an aperture 82 in the finger 80 and passes through an aperture 83 in the finger 81 to pivotally mount the second end of the spring 74 to a toggle 90 about a third pivot axis C. The fourth pivot pin 86 passes through the arcuate slot 70 of each spring arm 64, and further passes through a generally circular slot 88 in each frame plate 28.

Figure 7:
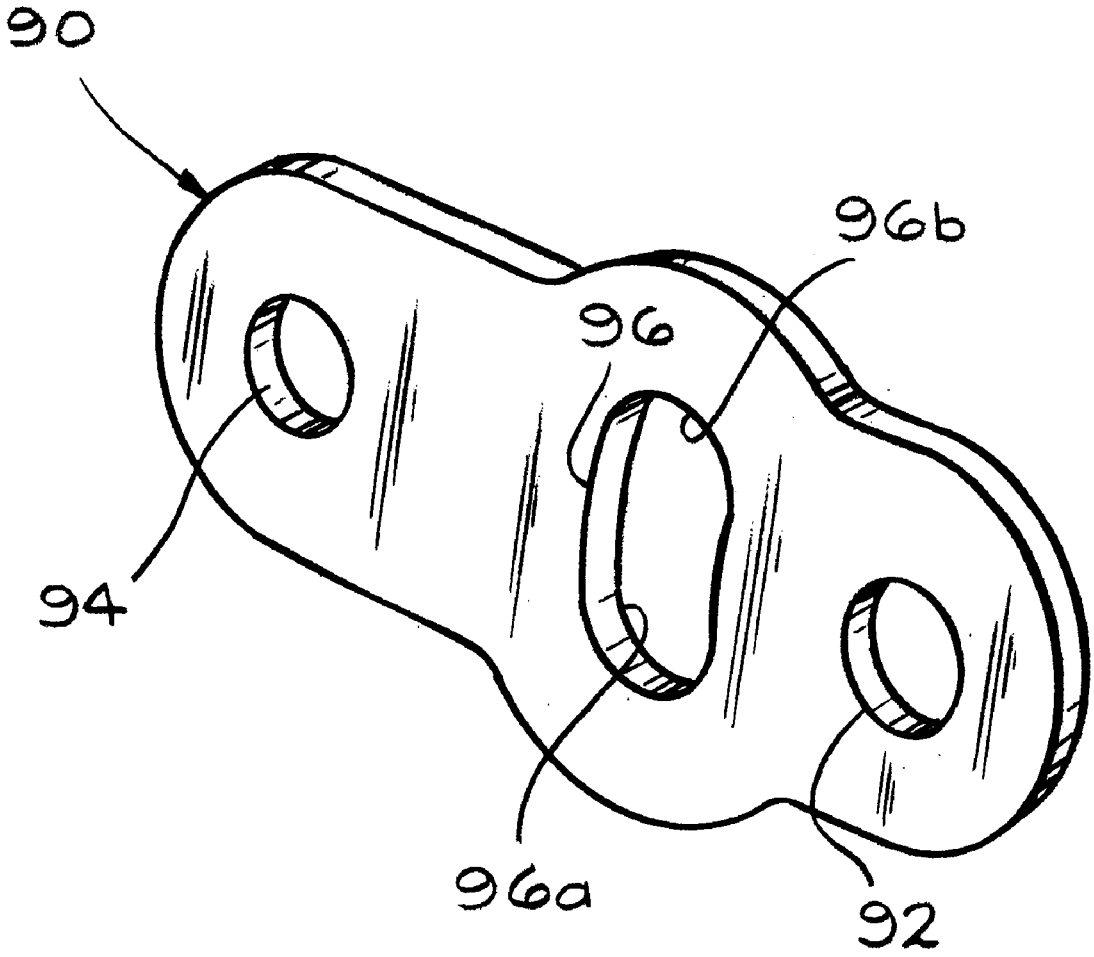
FIG. 7 is a perspective view of the toggle illustrated in FIG. 6.

As illustrated in FIG. 7, the toggle 90 includes a first aperture 92, a second aperture 94, and an arcuate slot 96. As shown in FIG. 6, the first pivot pin 58 passes through the first aperture 92 to pivotally mount to the toggle 90 about the first pivot axis A between the fingers 54 and 55 of the float arm 52. A fifth pivot pin 98 passes through a second aperture 100 in the finger 54, through a second aperture 102 in the finger 55, and through the arcuate slot 96 of the toggle 90.

Preferably, the components of the pump assembly 18 are made of stainless steel. Therefore, to reduce the reduce friction and wear associated with stainless steel to stainless steel contact, bushings are provided to reduce friction and wear between the pivot pins 58, 72, and 86, and the corresponding apertures of the frame plate 28, float arm 52, spring arm 64, and spring 74, as shown in FIG. 6. The bushings 104 have a generally cylindrical body 105 and a generally annular flange 106. Preferably the bushings 104 made of a material having a low coefficient of friction, such as, for example, Rulon® 641 manufactured by the Saint-Gobain Performance Plastics Company. Additionally, spacers or washers 107 may be disposed on pivot pins 58 and 72 between the bushings 104. It will be understood that each of the pivot pins 58, 60, 72, 86, and 98 may be secured to the pump assembly by any suitable means, such as, for example, retaining clips 109.

The mechanism 50 also includes a fluid detector, typically a float 108 as shown in FIG. 2, which may be connected to a float arm extension 110 by any suitable means, such as a threaded fastener 111. The float arm extension 10 is preferably connected to the float arm 52 through an opening (not shown) located at the end of float arm 52 opposite the fingers 54 and 55. Although the fluid detector shown in FIG. 2 is a float, other types of fluid detectors can be used, such as, for example, float switches, density based detectors, electrical resistance detectors, electrical capacitance detectors, pressure transducers, ultrasonic measuring devices, and optical measurement devices.

Referring now to FIG. 4, an actuator assembly 111 includes an elongate actuator 112 having an aperture (not shown) at one end and an elongate slot 116 at the other end. The third pivot pin 72 passes through the aperture of the actuator 112 to pivotally mount the actuator 112 about the pivot axis B between the fingers 76 and 77 of the first end of the spring 74.

Figure 5:
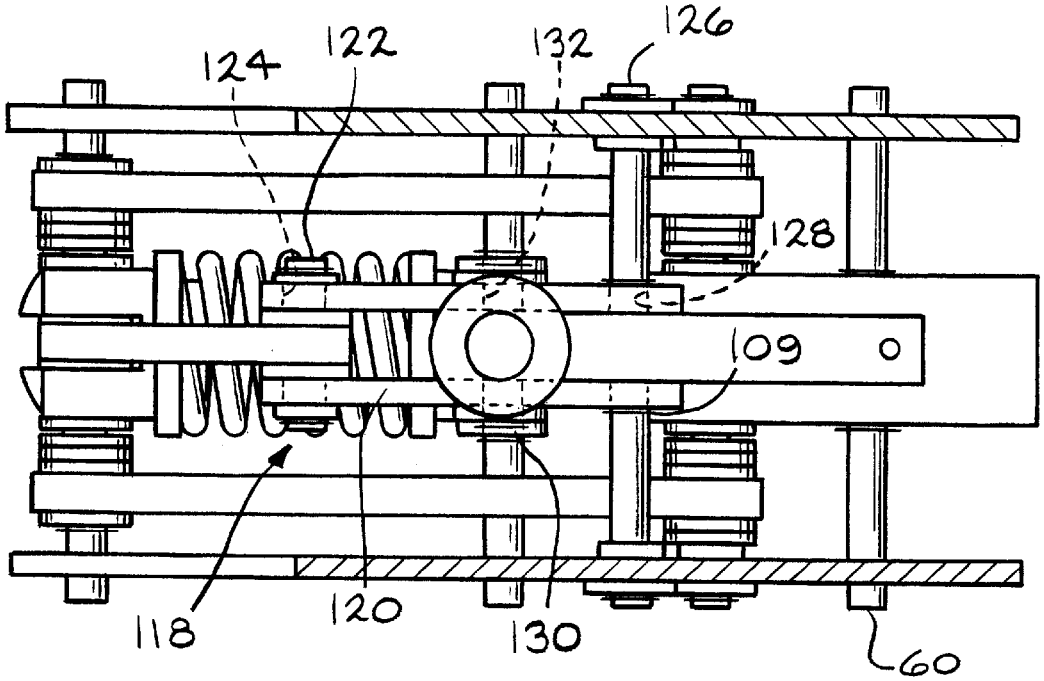
FIG. 5 is a cross-sectional view of the pump assembly taken along line 5—5 of FIG. 3.

Referring now to FIGS. 4 and 5, the actuator assembly 111 includes a linkage, shown generally at 118, having a pair of elongate arms 120. A sixth pivot pin 122 passes through a first aperture 124 at one end of each arm 120, and passes through the slot 116 of the actuator 112 to pivotally mount the linkage 118 to the actuator 112. A seventh pivot pin 126 passes through a second aperture 128 at the other end of each arm 120 to pivotally mount the linkage 118 to each frame plate 28 at a generally circular slot 129. An eighth pivot pin 130 passes through a third aperture 132, intermediate the apertures 124 and 128, of each arm 120. The pivot pin 130 further passes through an aperture (not shown) at one end of a generally L-shaped valve holder 136 to pivotally mount the linkage 118 to the valve holder 136. The other end of the valve holder 136 includes a generally hemispherical vent valve 138 and a steam inlet valve pin 140. The vent valve 138 cooperates with the valve seat 45 to close and open the vent valve assembly 43.

Bushings 104 are also provided to reduce friction and wear between the pivot pins 122 and 126, and the corresponding apertures of the linkage arms 120 and the frame plate 28. It will be understood that each of the pivot pins 122, 126, and 130, may be secured to the pump assembly by any suitable means, such as, for example, retaining clips 109.

As best seen in FIG. 4, the pin 140 cooperates with the valve 34 of the inlet valve assembly 33. When the float 108 is at its lowest position, as shown in FIG. 2, the inlet valve assembly 33 is closed and the vent valve assembly 43 is open. As the float 108 rises due to the fluid level rising in the tank 12, the float 108 pivots about the pivot axis A. The pivot pin 98 engages the toggle 90 at the slot 96. The toggle 90 in turn engages the spring 74 at the pivot pin 86. As the float 108 continues to rise, the pivot pin 86 is urged downwardly, thereby compressing the spring 74.

Referring now to FIGS. 2 and 4, when the float 108 reaches an upper tripping point, the energy stored in the spring 74 causes the second end of the spring 74 and the pivot pin 86 to snap downwards. The upper tripping point is defined as a line passing through pivot axes A, B, and C, when the pivot axis C moves to a point that is approximately co-linear with the pivot axes A and B.

Another important aspect of the invention is that the float 108 and its attached float arm 52 can travel freely through a first range of pivotal travel whereby the float pivots about the axis A, urges the pivot pin 98 downwardly within the arcuate slot 96 of the toggle 90 without engaging the mechanism 50, and thereby without compressing the spring 74. After the float 108 has traveled through a predetermined portion of its first range of pivotal travel, the float 108 and float arm 52 reach a point of maximum leverage relative to the spring 74. The pivot pin 98 then engages a lower surface 96*a*, shown in FIG. 7, of the slot 96 of the toggle 90, thereby urging the toggle 90 downwardly and compressing the spring 74.

When the second end of the spring 74 and the pivot pin 86 snap downwards through the upper tripping point, the spring arms 64 are caused to rotate about the pivot axis A, urging the pivot pin 72 and the attached actuator 112 upwardly within the arcuate slot 73 of each frame plate 28. Downward movement of the pivot pin 86 is limited by the circular slot 88 of each frame plate 28. The upward movement of the actuator 112 then causes the actuator 112 to engage the linkage 118.

Referring now to FIGS. 4 and 5, upward movement of the actuator 112 causes the actuator 112 to engage the arms 120 of the linkage 118 at the pivot pin 122, thereby causing the arms 120 to rotate about pivot pin 126. The rotation of the arms 120 causes the valve holder 136 to rotate about the pivot pin 130 and simultaneously move upward. The upward movement of the valve holder 136 then causes the pin 140 to drive the valve 36 off the valve seat 35 to open the valve assembly 33. The upward movement of the valve holder 136 further causes the vent valve 138 to be driven upward into sealing engagement with the valve seat 45 to close the vent valve assembly 43. It should be realized that upward movement of the actuator 112 will continue until the valve 138 engages the valve seat 45, and the vent valve assembly 43 is thereby closed.

In the preferred embodiment, the valve 138 is hemispherical in shape. However, it should be realized that the invention is not limited to the complementary shape of the valve 138 and the valve seat 45, and that the invention can be practiced with any complementary shape for the valve 138 and the valve seat 45.

As best seen in FIGS. 2 and 4, when the spring 74 snaps downward through the upper tripping point, the pin 60 of the float arm 52 engages a surface 62*a* of the arcuate slot 62 of each frame plate 28, thereby preventing further rotation of the float arm 52.

Once the valve assembly 33 is opened, a pressurized fluid, preferably steam, flows through the valve assembly 33 and develops a pressure within the tank 12 of sufficient magnitude to pump the accumulated fluid from the tank 12 though the fluid outlet valve 15.

As the fluid level in the tank 12 decreases, the float 108 drops downward and pivots about the pivot axis A. The pivot pin 98 engages the toggle 90 at the slot 96. The toggle 90 in turn engages the spring 74 at the pivot pin 86. As the float continues to drop, the pivot pin 86 is urged upwardly in the arcuate slot 70 of each spring arm 64, thereby compressing the spring 74. When the float 108 reaches a lower tripping point, the energy stored in the spring 74 causes the second end of the spring 74 and the pivot pin 86 to snap upwards. Similar to the upper tripping point, the lower tripping point is defined as a line passing through pivot axes A, B, and C, when the pivot axis C moves to a point that is approximately co-linear with the pivot axes A and B.

As described with regards to the upward movement of the float 108, a further important aspect of the invention is that the float 108 and its attached float arm 52 can travel freely during downward movement of the float 108 through a second range of pivotal travel whereby the float 108 pivots about the axis A, urges the pivot pin 98 upwardly within the arcuate slot 96 of the toggle 90 without engaging the mechanism 50, and thereby without compressing the spring 74. After the float 108 has traveled through a predetermined portion of its second range of pivotal travel, the float 108 and float arm 52 reach a point of maximum leverage relative to the spring 74. The pivot pin 98 then engages an upper surface 96*b* of the slot 96 of the toggle 90, thereby urging the toggle 90 upwardly and compressing the spring 74.

When the second end of the spring 74 and the pivot pin 86 snap upward through the lower tripping point, the spring arms 64 are caused to rotate about the pivot axis A, urging the pivot pin 72 and the attached actuator 112 downwardly within the arcuate slot 73 of each frame plate 28. Upward movement of the pivot pin 86 is limited by the circular slot 88 of each frame plate 28. As best seen in FIGS. 2 and 4, when the spring 74 snaps upward through the lower tripping point, the pin 60 of the float arm 52 engages a surface 62*b* of the arcuate slot 62 of each frame plate 28, thereby preventing further rotation of the float arm 52. Additionally, as the actuator 112 moves downward, the pivot pin 72 engages a surface 73*a* of the arcuate slot 73 of each frame plate 28, thereby stopping the downward movement of the actuator 112.

Another important aspect of the invention is the elongate slot 116 of the actuator 112. When the second end of the spring 74 and the pivot pin 86 snap upwards through the lower tripping point, the actuator 112 moves downward a predetermined distance relative to the linkage 118 without engaging the linkage 118. After the actuator 112 has traveled the predetermined distance relative to the linkage 118, an upper surface of the elongate slot 116 engages the pivot pin 122 of the linkage 118, thereby causing the linkage 118 to pivot about the pivot pin 126. The actuator 112 gains momentum as it travels the predetermined distance before engaging and applying a force to the linkage 118, and thereby opening the vent valve assembly 43. The force applied to the linkage 118 to open the vent valve assembly 43 is therefore improved over other commonly known pump assemblies.

The force generated by the downward movement of the actuator 112 causes the actuator 112 to engage the arms 120 of the linkage 118 at the pivot pin 122, thereby causing the arms 120 to rotate about pivot pin 126. The rotation of the arms 120 causes the valve holder 136 to rotate about the pivot pin 130 and simultaneously move downward. The downward movement of the valve holder 136 then causes the pin 140 to disengage the valve 36, allowing the valve 36 to sealing engage the valve seat 35, thereby closing the valve assembly 33. The downward movement of the valve holder 136 further causes the vent valve 138 to be driven downward from the valve seat 45 to open the vent valve assembly 43.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A pump for pumping fluid comprising:

a valve mechanism having an opened position and a closed position;

a spring assisted mechanism for selectively moving said valve mechanism between the opened position and the closed position; and a fluid detector for detecting the level of a pumping fluid, said fluid detector pivotally connected to said spring assisted mechanism and having a range of pivotal travel, said fluid detector further engaging a spring of said spring assisted mechanism;

whereby said fluid detector engages the spring of said spring assisted mechanism only at an engagement portion of the range of pivotal travel; and whereby said fluid detector is disengaged from said spring of said spring assisted mechanism at all other portions of the range of pivotal travel.

2. The pump according to claim 1 wherein the engagement portion of the range of pivotal travel whereby said fluid detector engages the spring of said spring assisted mechanism defines a point of maximum leverage of said fluid detector.

3. The pump according to claim 1 wherein said fluid detector is a float.

4. The pump according to claim 1 wherein said spring assisted mechanism is an over-center snap-action mechanism.

5. A pump for pumping fluid comprising:

a container;

a valve block mounted to said container, said valve block having a body, a pressurized-fluid inlet valve, and a pressure release valve; and a frame plate to which is mounted a mechanism for opening and closing said inlet valve and said pressure release valve in said valve block;

wherein said frame plate is mounted to said valve block; and wherein said valve block is readily removable from said container and from said frame plate.

6. The pump according to claim 5 wherein said valve block is mounted to said container by a plurality of fasteners, said valve block being readily removable from said container by removal of said fasteners.

7. The pump according to claim 5 further including a cap flange for attaching said frame plate and said valve block to a container, said cap flange being further attached to said valve block, wherein said valve block is readily removable from said frame plate and said cap flange.

8. The pump according to claim 6 wherein said valve block is mounted to said frame plate by a plurality of first fasteners, and mounted to said cap flange by a plurality of second fasteners, said valve block being readily removable from said frame plate by removal of said first fasteners, and being readily removable from said cap flange by removal of said second fasteners.

9. A pump for pumping fluid comprising:

a container;

a valve block having a valve mechanism;

an actuator assembly mounted to travel with respect to said valve block and connected to said valve block, said actuator assembly selectively actuating said valve mechanism between opened and closed positions; and a fluid detector for detecting the level of a pumping fluid mechanically linked to said actuator assembly;

whereby said actuator assembly is arranged to travel a predetermined distance relative to said valve block before said actuator assembly actuates said valve mechanism between the opened and the closed positions.

10. The pump according to claim wherein 9 said valve mechanism includes a pressure release valve, said actual or assembly actuating said pressure relief valve between the opened and the closed positions.

11. The pump according to claim 9 further including a linkage between an actuator of said actuator assembly and said valve mechanism, said linkage being pivotally attached to said actuator through a slot in said actuator, said linkage being further pivotally attached to said valve mechanism, whereby said actuator is arranged to travel a predetermined distance relative to said linkage before said actuator actuates said linkage.

12. The pump according to claim 9 wherein said linkage includes an arm having a width, the slot of said actuator having a length approximately equal to the width of said arm of said linkage.

13. The pump according to claim 9 wherein said linkage is pivotally attached to said actuator by a pin having a diameter, the slot of said actuator having a length approximately equal to twice the diameter of the pin of said linkage.

* * * * *

UNITED STATES PATENT AND TRADEMARK OFFICE

CERTIFICATE OF CORRECTION

PATENT NO. : 6,599,096 B1 
DATED : July 29, 2003
INVENTOR(S) : Timothy K. Totten and Matthew R. McNamara It is certified that error appears in the above-identified patent and that said Letters Patent is hereby corrected as shown below:

Column 8,
Line 1, after "claim", insert -- 9 --.
Line 1, after "wherein", delete "9".
Line 1, after "claim", change "9" to -- 11 -- (second occurrence).
Line 2, after "said", change "actual or" to -- actuator --.

Signed and Sealed this

Second Day of December, 2003

JAMES E. ROGAN
*Director of the United States Patent and Trademark Office*